US007021568B2

(12) United States Patent
Rieger et al.

(10) Patent No.: US 7,021,568 B2
(45) Date of Patent: Apr. 4, 2006

(54) FUEL INJECTION VALVE AND METHOD FOR OPERATING THE SAME

(75) Inventors: Franz Rieger, Schwieberdingen (DE); Harald Maisch, Koengen (DE); Michael Huebel, Gerlingen (DE); Ulrich Becker, Niefern-Oeschelbronn (DE); Juergen Stein, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 157 days.

(21) Appl. No.: 09/958,372

(22) PCT Filed: Feb. 2, 2001

(86) PCT No.: PCT/DE01/00423

§ 371 (c)(1),
(2), (4) Date: May 9, 2002

(87) PCT Pub. No.: WO01/57390

PCT Pub. Date: Aug. 9, 2001

(65) Prior Publication Data

US 2002/0170986 A1 Nov. 21, 2002

(30) Foreign Application Priority Data

Feb. 4, 2000 (DE) ..... 100 04 961

(51) Int. Cl.
*B05B 1/30* (2006.01)
*F02M 59/00* (2006.01)

(52) U.S. Cl. ..... 239/585.1; 239/585.3; 239/585.4; 239/585.5; 239/533.2; 239/88

(58) Field of Classification Search ..... 239/585.1, 239/585.2, 585.3, 585.4, 585.5, 533.2, 533.3, 239/88, 89, 90, 91, 92, 5, 95; 251/129.15, 251/129.21, 129.09, 129.1, 129.16
See application file for complete search history.

(56) References Cited

U.S. PATENT DOCUMENTS

| | | | | |
|---|---|---|---|---|
| 3,942,485 | A * | 3/1976 | Suda et al. | 123/490 |
| 5,235,954 | A * | 8/1993 | Sverdlin | 123/447 |
| 5,494,219 | A * | 2/1996 | Maley et al. | 239/88 |
| 5,964,192 | A * | 10/1999 | Ishii | 123/90.11 |
| 6,036,120 | A * | 3/2000 | Varble et al. | 239/585.1 |
| 6,065,684 | A * | 5/2000 | Varble et al. | 239/5 |
| 6,176,209 | B1 * | 1/2001 | Ishii | 123/90.11 |

FOREIGN PATENT DOCUMENTS

| | | |
|---|---|---|
| DE | 23 06 007 | 9/1973 |
| EP | 0 383 064 | 8/1990 |
| WO | WO 99/49210 | 9/1999 |

* cited by examiner

*Primary Examiner*—Davis Hwu
(74) *Attorney, Agent, or Firm*—Kenyon & Kenyon

(57) ABSTRACT

A fuel injector (1), in particular a fuel injector (1) for fuel injection systems, includes a first solenoid (2) cooperating with an armature (3), a second solenoid (4) cooperating with the armature (3), and a valve needle (13) friction-locked to the armature (3) for actuating a valve closing body, a force being exertable on the armature (3) in a closing direction using the first solenoid (2) and in an opening direction using the second solenoid (4).

20 Claims, 4 Drawing Sheets

FUEL INJECTION VALVE AND METHOD FOR OPERATING THE SAME

BACKGROUND INFORMATION

The present invention is based on a fuel injector according to the preamble of Claim 1 and a method of operating a fuel injector according to the preamble of Claim 10.

The closing times of fuel injectors are lengthened by adhesion forces between armature and core, as well as by eddy currents. It is known that delays can be reduced by making a current flow through the solenoid in the reverse direction at the end of the current pulse which excites the fuel injector in order to accelerate the decay of the residual field. The design of the corresponding control element is, however, complex and also only results in a slight shortening of the closing time.

Another option is to build up one magnetic field to open the fuel injector and a second magnetic field to hold the fuel injector in its open position. The intensity of the holding field can then be selected to be sufficiently low for the eddy currents to be small after the holding field is shut off, and thus the closing time can be shortened.

German Patent 23 06 007 C3 describes an electromagnetically actuated fuel injector for injecting fuel into an internal combustion engine in which the solenoid has three windings, which are supplied by three separate circuits. The first circuit is used for rapidly opening the fuel injector, the second circuit is used for holding the fuel injector open, and the third circuit is used for generating a counterfield extinguishing the residual magnetic field in order to rapidly close the fuel injector.

The disadvantage of the fuel injector known from German Patent 23 06 007 C3 is in particular the complex manufacturing process of an arrangement having three circuits, which supply three windings of the solenoid. The increased space required by the circuits is another disadvantage. No active resetting through a magnetic force component acting in the closing direction takes place.

ADVANTAGES OF THE INVENTION

The fuel injector according to the present invention having the features of Claim 1 has the advantage over the related art that a closing force can be generated in the closing direction using the first solenoid. According to the method described in Claim 10, the opening operation can be prepared by energizing both solenoids and subsequently switching off the solenoid acting in the closing direction. The beginning of the injection operation is then advantageously triggered by switching off one of the two solenoids, which is the opposite of the mode of operation of the conventional arrangement, where the opening operation is triggered by energizing the solenoid. The switching dynamics are positively influenced by the magnetic fields already present, which results in short opening times. The reverse procedure can be used in the closing operation in order to achieve short closing times.

Advantageous refinements of and improvements on the fuel injector described in Claim 1 and the method described in Claim 10 are possible through the measures presented in the subclaims.

The influence of eddy currents can be reduced by providing the magnetic circuit, e.g., the core parts or the injector housing, with an axial slit.

A radial gap between the magnetic circuits, which is filled with a non-magnetizable material, results in maximizing the magnetic forces, since the magnetic flux is weakened as it passes through the insulating material. Thus the magnetic fields do not interfere with one another.

The maximum force and a force equilibrium can be adjusted via the length in the radial direction of the gap arranged between the solenoids. The position of the gap in the axial direction with respect to the two solenoids allows the arrangement to be made symmetrical.

Also advantageous is energizing the two solenoids with currents of opposite polarities and approximately the same intensity, which induce two opposite fields.

Also advantageous are recesses in the armature parts, which allow the weight of the movable parts to be substantially reduced without affecting the magnetic force.

DRAWING

An embodiment of the present invention is illustrated in the drawing in a simplified manner and explained in more detail in the description that follows.

FIG. 1 shows a partial section through an embodiment of a fuel injector according to the present invention;

FIG. 2 shows a diagram of the switching phases of the embodiment illustrated in FIG. 1 of the fuel injector according to the present invention and the forces acting during the switching operations;

FIG. 3 shows a detail of the fuel injector according to the present invention illustrated in FIG. 1 in area III of FIG. 1;

FIGS. 4A–4B show the diffusion of the magnetic field for a magnetic core without a slit and with two slits in section plane IV—IV of FIG. 1; and FIGS. 5A–5B show the eddy currents in a magnetic core without a slit and with two slits in section plane V—V of FIG. 1.

DESCRIPTION OF THE EXEMPLARY EMBODIMENT

FIG. 1 shows a partial section through the central part of a fuel injector 1. Fuel injector 1 is designed in particular for direct injection of fuel into a combustion chamber (not illustrated) of an internal combustion engine in which a compressed mixture is externally ignited. Fuel injector 1 can be designed as an inward-opening or an outward-opening fuel injector 1. The embodiment illustrated in FIG. 1 is an inward-opening fuel injector 1.

Fuel injector 1 includes a first solenoid 2, which cooperates with a first armature part 5*a* of an armature 3, which is a two-part armature in this embodiment, and a second solenoid 4, which cooperates with a second armature part 5*b* of armature 3. First solenoid 2 is wound onto a first field spool 6 and second solenoid 4 is wound onto second field spool 7. First solenoid 2 surrounds a first core part 8, while second solenoid 4 surrounds a second core part 9. First solenoid 2 and second solenoid 4 are separated in the axial direction by a web 10. Web 10 is composed of a first web part 10*a* facing first solenoid 2 and a second web part 10*b* facing second solenoid 4; the two web parts are separated by a layer 11 made of non-magnetizable material.

Web parts 10*a* and 10*b* are not necessarily of the same size. The axial position of layer 11 can be adjusted in order to optimize the opening or closing operation. If the equilibrium of forces is optimized to favor the opening operation, for example, the axial position of non-magnetizable layer 11 is slightly shifted from the center position toward first solenoid 2. Thus the magnetic flux density in web part 10*a* adjacent to first solenoid 2 is increased with respect to that in web part 10*b*.

First armature part 5*a* and second armature part 5*b* are arranged between first core part 8 and second core part 9. In this embodiment, each armature part 5*a* and 5*b* has a conical recess 12 which results in a reduction in weight of the movable parts.

A valve needle 13 extends through first core part 8, second core part 9, and the two armature parts 5*a* and 5*b*. When fuel injector 1 is closed, a working gap 25 is formed between second armature part 5*b* and second core part 9. First armature part 5*a* is mechanically linked to valve needle 13 via a first flange 14, while second armature part 5*b* is mechanically linked to valve needle 13 via a second flange 15.

A restoring spring 17, which presses valve needle 13 in the direction of injection onto a sealing seat (not illustrated) and thus holds fuel injector 1 in the closed position, is mounted between a pre-tensioning sleeve 16 pressed, in particular, into a central recess 23 of second core part 9 and second flange 15.

Viewed from first core part 8 in the direction of injection, a guide element 18, a sealing element 19, and a valve closing body (not illustrated) follow.

Fuel injector 1 is surrounded by an injector housing 20, which has one slit or, ideally, two slits 21 in the area of second solenoid 4 and in the area of first solenoid 2, for example. These slits run in the axial direction and are responsible for reducing the influence of eddy currents, i.e., of the diffusion of the magnetic field induced in injector housing 20 during the operation of fuel injector 1. As an alternative to a slitted injector housing 20, such slits 21 can also be provided in core parts 8 and 9, for example, as can be seen in FIGS. 4B and 5B.

The fuel is supplied in the center and is guided to the sealing seat in the flow direction shown by arrow 22 through central recess 23 of fuel injector 1 and through fuel channels 24*a* in armature parts 5*a* and 5*b* and fuel channels 24*b* in guide element 18.

If excitation currents in opposite directions are applied to first solenoid 2 and second solenoid 4, magnetic fields of opposite polarities are induced in first solenoid 2 and second solenoid 4. Since the magnetic fields in first solenoid 2 and in second solenoid 4 have opposite polarities, the effect of the magnetic fields in the direction of injection and in the direction of feed is initially canceled out. Armature 3 is held in contact with first core part 8 by the magnetic force of first solenoid 2 acting on it. The effect of second solenoid 4 is small due to working gap 25 between second armature part 5*b* and second core part 9.

In order to open fuel injector 1, the current which excites first solenoid 2 is switched off, whereby no more magnetic force is exerted by first solenoid 2 on armature 3. Armature 3 is now drawn into second solenoid 4 by a distance which corresponds to working gap 25 against the force of restoring spring 17. Thus valve needle 13 is entrained by armature 3 in the opening direction via second flange 15. At the injection side end of valve needle 13, a valve closing body (not illustrated) is formed, which is lifted by the motion of valve needle 13 from a valve seat surface (not illustrated), thus opening fuel injector 1.

Working gap 5*b* formed between second armature part 5*b* and second core part 9 is now closed. A working gap 25 of the same size is between first armature part 5*a* and first core part 8 when fuel injector 1 is open.

In preparation for the closing operation, first solenoid 2 is energized again, so that a force acts on armature 3 in the direction of first solenoid 2 which, however, is less than the force exerted by second solenoid 4 due to working gap 25. If now the current which excites second solenoid 4, is switched off, armature 3, together with valve needle 13, is accelerated in the direction of injection by the sum of forces of restoring spring 17 and first solenoid 2. A rapid closing motion is achieved due to first solenoid 2 having been energized previously and the resulting drop of armature 3 from second core part 9. Short and, more importantly, accurate closing times, which are only slightly influenced by adhesion and eddy currents, are the positive result.

FIG. 2 qualitatively shows the forces acting during the opening and closing operations of fuel injector 1.

The top diagram indicates electrical control command $t_1$ for opening the injector. In the second diagram in the center, the acting magnetic forces $F_{mag}$ are shown as a function of time t. The magnetic force of second solenoid 4 is shown above the time axis, while the magnetic force of first solenoid 2 is shown under the time axis. In preparation for opening fuel injector 1, first solenoid 2 and second solenoid 4 are energized at the same time with currents of the same absolute value but of opposite polarities. When the two magnetic fields have reached their full intensity, first solenoid 2 is switched off in order to open fuel injector 1. The magnetic force of second solenoid 4 attracts armature 3 in the opening direction. When armature 3 hits second core part 9, the magnetic force can be reduced by reducing the excitation current to the necessary holding force.

In preparation for closing fuel injector 1, first solenoid 2 is energized again and, at the same time, the excitation current through second solenoid 4 is increased again. Thus first solenoid 2 exerts a magnetic force on armature 3 again, which, together with the force of restoring spring 17, moves valve needle 13, via first flange 14 and second flange 15, in the closing direction after second solenoid 4 is switched off. After completion of the motion phase of armature 3, the magnetic force slowly drops to zero after the current which excites first solenoid 2 is switched off.

The bottom diagram of FIG. 2 represents the sum of forces (magnetic force of first and second solenoids 2 and 4 and restoring force of restoring spring 17). If first solenoid 2 and second solenoid 4 are energized in the preparation phase for opening fuel injector 1, only the restoring force of restoring spring 17 remains as the resultant force, since the magnetic fields are of the same intensity but opposite polarities. Restoring spring 17 holds fuel injector 1 closed in this phase. If first solenoid 2 is switched off, the magnetic force of second solenoid 4 will exceed the restoring force of restoring spring 17, opening fuel injector 1. When armature 3 reaches its end position, the magnetic force is reduced again by the reduction of the excitation current to its holding current intensity. However, it still exceeds the force of restoring spring 17, so that fuel injector 1 remains in the open position. When first solenoid 2 is energized again in preparation for the closing operation, initially this has no effect on the prevailing relationship of forces. The magnetic force of first solenoid 2 and the restoring force of restoring spring 17 do not act in the same direction until second solenoid 4 is turned off, whereby fuel injector 1 is closed.

FIG. 3 shows a partial section through a detail of the embodiment of fuel injector 1 according to the present invention described in FIG. 1 in area III of FIG. 1. In order to illustrate the effect of non-magnetizable layer 11 between first web part 10*a* and second web part 10*b* between first solenoid 2 and second solenoid 4, the energized and nonenergized states of first solenoid 2 and second solenoid 4 during the open phase of fuel injector 1 are shown. The drawing only shows those parts of fuel injector 1 which are needed to elucidate the operation. Components described previously are identified with the same reference symbols.

It can be seen from magnetic field lines 30 shown in FIG. 3 that they only penetrate injector housing 20 in the area of second solenoid 4, second core part 9, and second armature part 5*b* due to the geometry of the arrangement and the position of non-magnetizable layer 11. Those portions of the magnetic field which penetrate first armature part 5*a*, injector housing 20 in the area of first solenoid 2, and first core part 8 are extremely small. The material of non-magnetizable layer 11 and its position between first solenoid 2 and second solenoid 4, and its axial extent can be selected so that the losses almost entirely disappear. The position of layer 11 makes it possible to optimize either the opening or the closing operation, depending on whether layer 11 is arranged closer to first solenoid 2 or second solenoid 4, since either first armature part 5*a* or second armature part 5*b* are influenced more strongly by the respective magnetic field. In order to simplify the manufacturing of injector housing 20, when it is desirable, for example, to make injector housing 20 of a single piece, the radial extent of layer 11 does not need to divide the entire injector housing 20. It is sufficient to provide a slit up to the desired radial extent in injector housing 20 and to fill it with non-magnetizable layer 11.

In order to illustrate the previously mentioned radial slits 21, the diffusion of the magnetic field is shown in FIGS. 4A and 4B in a radial sectional view and the shape of the eddy currents in core part 8 is shown in FIGS. 5A and 5B in a radial sectional view. The slits run along lines IV—IV, V—V in FIG. 1.

FIG. 4A shows a radial section through an unslitted core part 8 along IV—IV and the diffusion of the magnetic field of first solenoid 2 induced in core part 8 for comparison.

FIG. 4B shows a radial section through core part 8 along line IV—IV in a doubly slitted area and the diffusion of the magnetic field of first solenoid 2 induced in core part 8. Core part 8 is subdivided into two parts 8*a* and 8*b* by slit 21. The magnetic field is not a closed circle between parts 8*a* and 8*b* due to slits 21. Thus losses can be kept low, which has a positive effect on the excitation performance of the magnetic circuits.

FIG. 5A shows the shape of the eddy currents in a closed core part 8 in a radial section along line V—V for comparison. The eddy currents are highly pronounced due to the uninterrupted shape of core part 8 and therefore have a substantial effect on the closing time of fuel injector 1.

FIG. 5B shows a section along line V—V through doubly slitted core part 8. The eddy currents do not occur here due to slit 21, but build up in the two parts 8*a* and 8*b* to form closed eddy currents again. The effect of the eddy currents is thereby reduced overall.

The present invention is not limited to the described embodiment, but is suited for fuel injectors 1 of any design, in particular also for outward-opening fuel injectors 1.

What is claimed is:

1. A fuel injector, comprising:

an armature;

a first solenoid cooperating with the armature;

a second solenoid cooperating with the armature;

a non-magnetizable layer arranged between the first solenoid and the second solenoid; and a valve needle friction-locked to the armature and configured to actuate a valve closing body, wherein the first solenoid is configured to exert a force on the armature in a closing direction and the second solenoid is configured to exert a force on the armature in an opening direction, and wherein the first and the second solenoids are configured to open the fuel injector by a switching off of the first solenoid.

2. The fuel injector according to claim 1, wherein the fuel injector is configured as a fuel injector for a fuel injection system of an internal combustion engine.

3. The fuel injector according to claim 1, further comprising at least one of an injector housing and at least one core part configured as an internal pole of the fuel injector, wherein the at least one of the injector housing and the at least one core part includes at least one slit in an axial direction.

4. The fuel injector according to claim 3, wherein the slit extends along at least one of the first solenoid and the second solenoid.

5. The fuel injector according to claim 1, further comprising a web arranged between the first solenoid and the second solenoid, the non-magnetizable layer dividing the web into a first web part facing the first solenoid and a second web part facing the second solenoid.

6. The fuel injector according to claim 5, wherein a distance between the first solenoid and the non-magnetizable layer and a distance between the second solenoid and the non-magnetizable layer are of different magnitudes.

7. The fuel injector according to claim 6, wherein the non-magnetizable layer is arranged closer to the first solenoid than to the second solenoid.

8. The fuel injector according to claim 1, wherein the fuel injector is configured as one of an inward-opening and an outward-opening fuel injector.

9. The fuel injector according to claim 1, wherein the switching off of the first solenoid is subsequent to an initial energizing of the first and second solenoids.

10. The fuel injector according to claim 1, wherein:

the valve closing body, when actuated by the valve needle, cooperates with a valve seat to open and close a valve; and when the valve is open, the fuel injector is configured to spray-discharge fuel supplied within the fuel injector.

11. A fuel injector, comprising:

an armature;

a first solenoid cooperating with the armature;

a second solenoid cooperating with the armature; and a valve needle friction-locked to the armature and configured to actuate a valve closing body, wherein the first solenoid is configured to exert a force on the armature in a closing direction and the second solenoid is configured to exert a force on the armature in an opening direction, wherein the first and the second solenoids are configured to open the fuel injector by a switching off of the first solenoid, and wherein the armature is divided into a first armature part and a second armature part, the first armature part being mechanically linked to the valve needle via a first flange, the second armature part being mechanically linked to the valve needle via a second flange.

12. The fuel injector according to claim 11, wherein each of the first armature part and the second armature part includes a conical recess.

13. The fuel injector according to claim 11, wherein:

the valve closing body, when actuated by the valve needle, cooperates with a valve seat to open and close a valve; and when the valve is open, the fuel injector is configured to spray-discharge fuel supplied within the fuel injector.

14. A method for operating a fuel injector, the fuel injector including a first solenoid cooperating with an armature, a second solenoid cooperating with the armature and a valve needle friction-locked to the armature and configured to actuate a valve closing body, the first solenoid being configured to exert a force on the armature in a closing direction, the second solenoid being configured to exert a force on the armature in an opening direction, comprising the step of:

opening the fuel injector by initially energizing the first solenoid and the second solenoid and subsequently switching off the first solenoid.

15. The method according to claim 14, wherein the fuel injector is configured as a fuel injector for a fuel injection system of an internal combustion engine.

16. The method according to claim 14, further comprising the step of closing the fuel injector by energizing the first solenoid and subsequently switching off the second solenoid.

17. A fuel injector, comprising:

an armature;

a first solenoid cooperating with the armature;

a second solenoid cooperating with the armature;

a non-magnetizable layer arranged between the first solenoid and the second solenoid;

a valve needle friction-locked to the armature and configured to actuate a valve closing body; and at least one of an injector housing and at least one core part configured as an internal pole of the fuel injector, wherein the first solenoid is configured to exert a force on the armature in a closing direction and the second solenoid is configured to exert a force on the armature in an opening direction, wherein, with respect to a flow direction, the first solenoid is arranged downstream of the second solenoid, and wherein the at least one of the injector housing and the at least one core part includes at least one slit in an axial direction.

18. The fuel injector according to claim 17, wherein the fuel injector is configured as a fuel injector for a fuel injection system of an internal combustion engine.

19. The fuel injector according to claim 17, wherein the non-magnetizable layer is arranged closer to the first solenoid than to the second solenoid.

20. A fuel injector, comprising:

an armature;

a first solenoid cooperating with the armature;

a second solenoid cooperating with the armature;

a valve needle friction-locked to the armature and configured to actuate a valve closing body; and at least one of an injector housing and at least one core part configured as an internal pole of the fuel injector, wherein the first solenoid is configured to exert a force on the armature in a closing direction and the second solenoid is configured to exert a force on the armature in an opening direction, wherein, with respect to a flow direction, the first solenoid is arranged downstream of the second solenoid, wherein the at least one of the injector housing and the at least one core part includes at least one slit in an axial direction, and wherein the armature is divided into a first armature part and a second armature part, the first armature part being mechanically linked to the valve needle via a first flange, the second armature part being mechanically linked to the valve needle via a second flange.

* * * * *

UNITED STATES PATENT AND TRADEMARK OFFICE

CERTIFICATE OF CORRECTION

PATENT NO. : 7,021,568 B2
APPLICATION NO. : 09/958372
DATED : April 4, 2006
INVENTOR(S) : Rieger et al.

It is certified that error appears in the above-identified patent and that said Letters Patent is hereby corrected as shown below:

On the title page
(57) Abstract

Line 1, change "A fuel injector(1)," to --A fuel injector,--

Line 1, delete "(1)"

Line 2, delete "(2)"

Line 3, change "an armature (3)," to --an armature,--

Line 3, delete "(4)"

Line 4, change " the armature (3)," to --the armature,--

Line 4, delete "(13)"

Line 5, delete "(3)"

Line 6, delete "(3)"

Line 7, delete "(2)"

Line 8, change "the second solenoid (4)." to --the second solenoid.--

Column 1, line 4, change "BACKGROUND INFORMATION." to --FIELD OF THE INVENTION .--

Column 1, line 6, change "is based on" to -- relates to--

Column 1, lines 6-7, delete "according to the preamble of Claim 1"

Column 1, line 8, change "injector according to the preamble of Claim 10," to -- injector--

Column 1, line 11, change "It is known" to --It is conventional--

Column 1, line 24, change " German Patent 23 06 007 C3" to --German Published Patent Application No. 23 06 007--

UNITED STATES PATENT AND TRADEMARK OFFICE

CERTIFICATE OF CORRECTION

PATENT NO. : 7,021,568 B2
APPLICATION NO. : 09/958372
DATED : April 4, 2006
INVENTOR(S) : Rieger et al.

It is certified that error appears in the above-identified patent and that said Letters Patent is hereby corrected as shown below:

Column 1, line 33, change " the fuel injector known from" to --the fuel injector described in--

Column 1, line 34 , change "Patent 23 06 007 C3" to --Published Patent Application No. 23 06 007--

Column 1, line 40, change " ADVANTAGES OF THE INVENTION" to --SUMMARY--

Column 1, line 43-44, delete "having the features of Claim 1"

Column 1, line 44, change "has the advantage" to --includes the advantage--

Column 1, lines 44-45, delete "over the related art"

Column 1, line 45, change "can be generated" to --may be generated--

Column 1, line 47, change "described in Claim 10" to --of the present invention,--

Column 1, line 47, change "operation can be" to --operation may be--

Column 1, line 50, change " operation is then advantageously" to --operation may be--

Column 1, line 53, change " where the opening," to --in which the opening--

Column 1, line 57, change "can be used" to --may be used--

Column 1, line 59, change "Advantageous refinements" to --Further refinements--

Column 1, line 60, delete "described in Claim 1"

Column 1, line 60-62, change " described in Claim 10 are possible through the measures presented in the subclaims." to --according to the present invention are possible.--

Column 1, line 63, change "can be reduced" to --may be reduced--

UNITED STATES PATENT AND TRADEMARK OFFICE

CERTIFICATE OF CORRECTION

PATENT NO. : 7,021,568 B2
APPLICATION NO. : 09/958372
DATED : April 4, 2006
INVENTOR(S) : Rieger et al.

It is certified that error appears in the above-identified patent and that said Letters Patent is hereby corrected as shown below:

Column 2, line 2, change "Thus the magnetic" to --Thus, the magnetic--

Column 2, line 4, change "equilibrium can be" to --equilibrium may be--

Column 2, line 9, change "is energizing" to --may be energizing--

Column 2, line 12, change "are recesses" to --may be recesses--

Column 2, delete lines 16-35 and replace with the following

Column 2, lines 37-38, change "DESCRIPTION OF THE EXEMPLARY EMBODIMENT" to --DETAILED DESCRIPTION--

Figure 1:
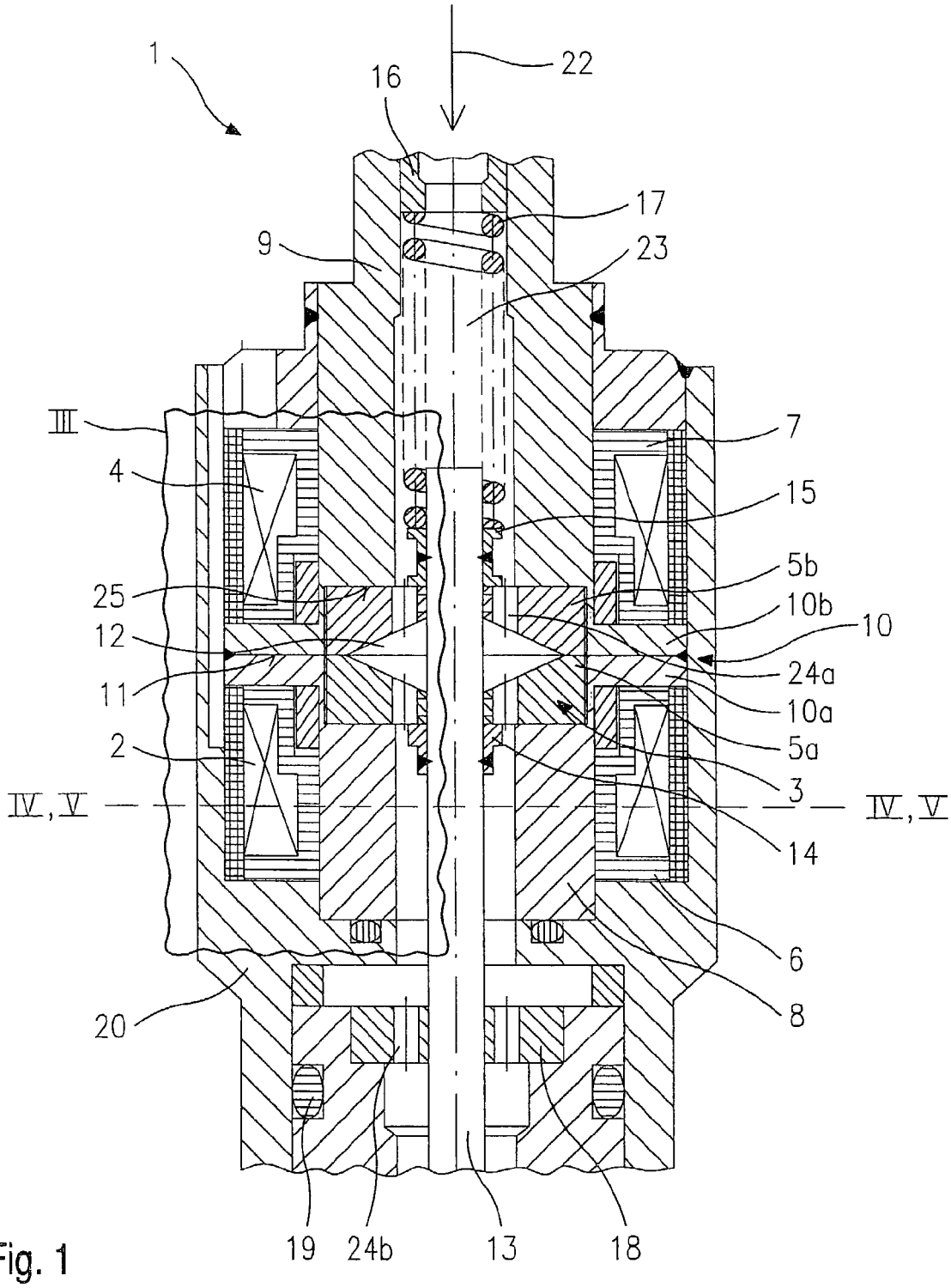
Fig. 1 is a partial cross-sectional view through an example embodiment of a fuel injector according to the present invention.

Column 2, line 41, change "FIG. 1 shows" to --FIG. 1 illustrates--

Column 2, line 42, change "Fuel injector 1 is designed" to --Fuel injector 1 is configured--

Column 2, lines 43-44, delete "(not illustrated)"

Column 2, lines 45-46, change "Fuel injector 1 can be designed" to --Fuel injector may be configured--

Column 2, line 47, change "The embodiment" to --The example embodiment--

UNITED STATES PATENT AND TRADEMARK OFFICE

CERTIFICATE OF CORRECTION

PATENT NO. : 7,021,568 B2
APPLICATION NO. : 09/958372
DATED : April 4, 2006
INVENTOR(S) : Rieger et al.

It is certified that error appears in the above-identified patent and that said Letters Patent is hereby corrected as shown below:

Column 2, line 60, change "solenoid 4 ; the two web parts" to --solenoid 4. The two web parts--

Column 2, line 63, change "can be adjusted" to --may be adjusted--

Column 3, line 1, change "Thus the magnetic" to --Thus, the magnetic--

Column 3, line 6, change "has a conical" to --includes a conical--

Column 3, line 18, delete "(not illustrated)"

Column 3, line 25, delete "(not illustrated)"

Column 3, line 27, change "which has one slit or, ideally" to --which includes one slit or, e.g.,--

Column 3, line 30, change "Those slits run" to --Those slits extend--

Column 3, line 34, change "slits 21 can" to --slits 21 may--

Column 3, line 35, change "for example, as can" to --for example, as may--

Column 3, line 38, change "flow direction shown" to --flow direction illustrated--

Column 3, line 53, change "current which excites" to --current that excites--

Column 3, line 61, delete "(not illustrated)"

Column 3, line 62, delete "(not illustrated)"

Column 3, line 65, change "is now closed" to --is closed--

Column 4, line 2, change "energized again," to --energized,--

Column 4, line 5, change "If now the current which excites" to --If the current that excites--

Column 4, line 14, change "shows the forces" to --illustrates the forces--

Column 4, line 18, change "are shown as" to --are illustrated as--

UNITED STATES PATENT AND TRADEMARK OFFICE

CERTIFICATE OF CORRECTION

PATENT NO. : 7,021,568 B2
APPLICATION NO. : 09/958372
DATED : April 4, 2006
INVENTOR(S) : Rieger et al.

It is certified that error appears in the above-identified patent and that said Letters Patent is hereby corrected as shown below:

Column 4, line 19, change "solenoid 4 is shown" to --solenoid 4 is illustrated--

Column 4, line 21, change "solenoid 2 is shown" to --solenoid 2 is illustrated--

Column 4, line 29, change "can be reduced" to --maybe reduced--

Column 4, line 32, change " is energized again" to --is energized--

Column 4, line 33, change "is increased again. Thus" to --is increased. Thus,--

Column 4, line 34, change "on armature 3 again," to --on armature 3,--

Figure 2:
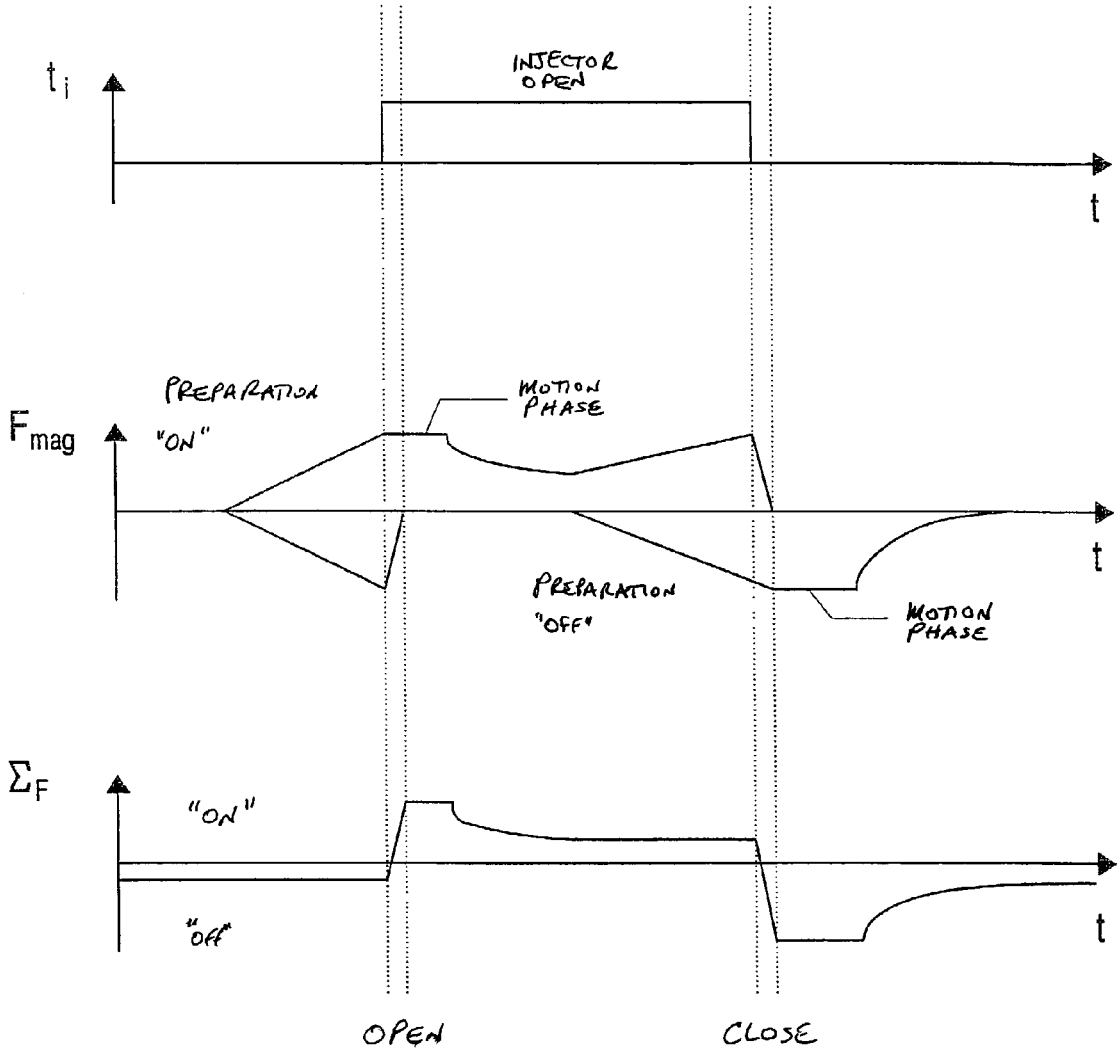
Fig. 2 is diagram of the switching phases of the fuel injector illustrated in Fig. 1 and the forces acting during the switching operations.

Column 4, line 41, change "diagram of FIG. 2" to --diagram illustrated in FIG. 2--

Column 4, line 53, delete "again"

Column 4, line 56, change "is energized again" to --is energized--

Figure 3:
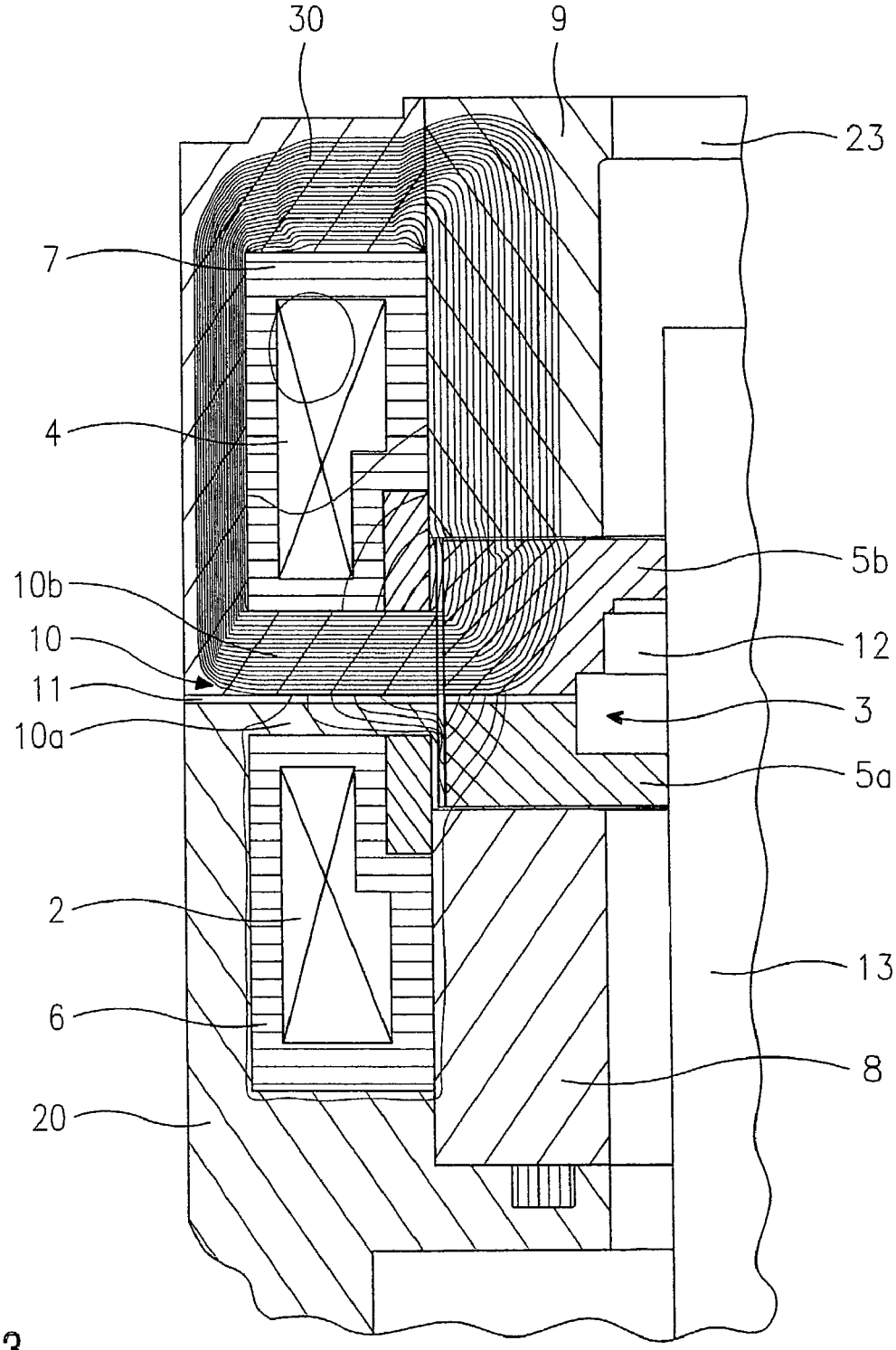
Fig. 3 is a detailed cross-sectional view of the fuel injector illustrated in Fig. 1 in area III of Fig. 1.
Figure 4A:
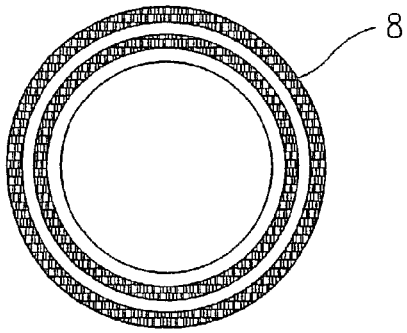
Figs. 4A and 4 B illustrate the diffusion of the magnetic field for a magnetic core without a slit and with two slits in sectional plane IV-IV illustrated in Fig. 1.

Column 4, line 62, change "FIG. 3 shows" to --FIG. 3 illustrates--

Column 4, lines 62-63, change "of the embodiment" to --of the example embodiment--

Column 4, line 64, change "described in FIG. 1" to --illustrated in FIG. 1--

Column 5, line 2, change "are shown" to --are illustrated--

Column 5, line 3, change "drawing only shows which are" to --drawing only illustrates that are--

Column 5, line 6, change "shown in FIG." to --illustrated in FIG.--

Column 5, line 11, change "field which penetrate" to --field that penetrate--

Column 5, line 15, change "can be selected" to --may be selected--

Column 5, line 29, change "is shown in" to --is illustrated in--

Column 5, line 30, change "radial sectional view" to --radial cross-sectional view--

Column 5, line 31, change "is shown in" to --is illustrated in--

UNITED STATES PATENT AND TRADEMARK OFFICE

CERTIFICATE OF CORRECTION

PATENT NO. : 7,021,568 B2
APPLICATION NO. : 09/958372
DATED : April 4, 2006
INVENTOR(S) : Rieger et al.

It is certified that error appears in the above-identified patent and that said Letters Patent is hereby corrected as shown below:

Column 5, line 32, change "radial sectional view. The slits run" to --radial cross-sectional view. The slits extend--

Figure 5A:
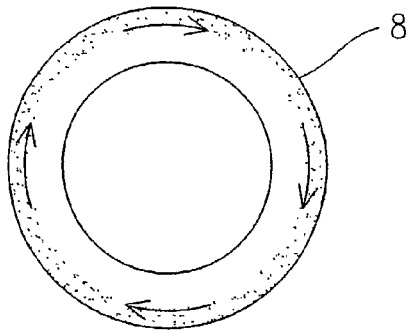
Figs. 5A and 5 B illustrate the eddy currents in a magnetic core without a slit and with two slits in a sectional plane V-V illustrated in Fig. 1.
Figure 4B:
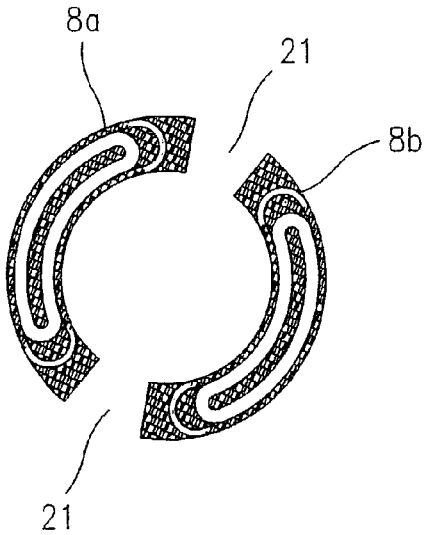

Column 5, line 45, change "FIG. 5A shows" to --FIG. 5A illustrates--

Column 5, line 46, change "radial section along line V-V" to --radial section taken along the line V-V--

Figure 5B:
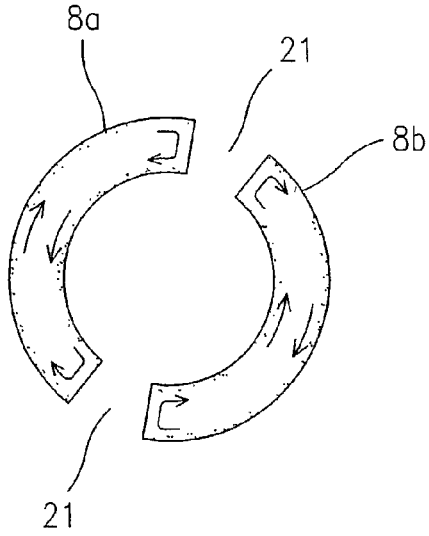

Column 5, line 50, change "FIG. 5B shows a section along line V-V" to --FIG. 5B illustrates a section taken along the line V-V --

Column 5, line 51, change "do not occur here" to --do not occur--

Column 5, line 53, change "closed eddy currents again." to --closed eddy currents.--

Column 5, lines 55-56, change "the described embodiment" to --the described example embodiment--

Column 5, line 56, change "of any design," to --of any configuration,--

Signed and Sealed this

Seventeenth Day of July, 2007

JON W. DUDAS
*Director of the United States Patent and Trademark Office*